United States Patent [19]

Stormby

[11] 4,455,188

[45] Jun. 19, 1984

[54] AUTOMATIC APPARATUS FOR APPLYING COVER-SLIPS ON SLIDES

[76] Inventor: Nils G. I. Stormby, Fridhemsvägen, Malmö, Sweden

[21] Appl. No.: 439,720

[22] Filed: Nov. 8, 1982

[30] Foreign Application Priority Data

Dec. 1, 1981 [SE] Sweden ..... 8107162

[51] Int. Cl.[3] ..... B26D 5/00

[52] U.S. Cl. ..... 156/355; 156/357; 156/363; 156/364; 156/521; 156/522

[58] Field of Search ..... 156/521, 522, 353–355, 156/356–357, 361–363, 518, 519, 520; 206/454–456

[56] References Cited

U.S. PATENT DOCUMENTS 3,480,504 11/1969 Good et al. ..... 156/356
3,819,448 6/1974 Beever ..... 156/355
3,886,033 5/1975 McDonald ..... 156/522
3,926,305 12/1975 Wallestad ..... 206/454 X
4,082,595 4/1978 Slater ..... 156/361 X

*Primary Examiner*—David A. Simmons
*Attorney, Agent, or Firm*—Brumbaugh, Graves, Donohue & Raymond

[57] ABSTRACT

Cover-slips are automatically applied to slides carrying specimens by feeding slides from a cassette to a conveyor, severing lengths of cover-slip material from a supply and advancing them in timed relation to the movement of the slides to an application station, depositing on each slide a quantity of solvent for an adhesive carried by the cover-slip material, compressing each slide with a cover-slip superimposed thereon in a nip at the application station, and delivering the finished slides to a removable cassette for storage in stacked relation therein.

4 Claims, 10 Drawing Figures

AUTOMATIC APPARATUS FOR APPLYING COVER-SLIPS ON SLIDES

The present invention relates to automatic apparatus for the application of cover-slips on slides carrying specimens for microscopic examination, in which the cover-slips are in the form of endless ribbon having a pre-applied coating of adhesive on one side thereof and the slides carrying the specimens are provided with a solvent intended to effect subsequent adhesion between slide and cover-slip.

Background of the Invention

Prior U.S. Pat. No. 4,203,797 discloses a machine for applying cover-slips of the type mentioned above in which the cover-slips are fed manually, after which the machine is started by hand and completes one work cycle at a time. The slides are collected by hand from trays or metal cassettes and, after application of the cover-slips, are returned to the places from which they were taken. While this technique is effective, it is extremely time consuming and entails an obvious risk of personnel being injured by the solvent which must be used. Another disadvantage with the known method is the risk of cutting fingers which exists when slides are handled manually.

It is an object of the present invention, accordingly, to provide fully automatic apparatus for the application of cover-slips on slides, which is free from the above noted drawbacks and risks inherent in the known procedure.

Another object of the present invention is to provide novel apparatus of the above character in which a considerable number of slides can be loaded and automatically provided with cover-slips without supervision.

Yet another object of the present invention is to provide novel apparatus of the above character which, although simple in construction, effects correct severing of a covering material in ribbon form to produce the cover-slips and correct application of the cover-slips on the slides.

A further object of the invention is to provide novel apparatus of the above character in which the synchronized feeding of the slides and the cover-slip material is effected in a simple and reliable manner.

SUMMARY OF THE INVENTION

These and other objects of the invention are attained by automatically feeding slides stacked in a removable cassette to a moving conveyor, severing lengths of cover-slip material from a supply and advancing them in timed relation to the movement of the slides on the conveyor to a station where they are to be applied to the slides, depositing on each slide as it approaches the application station a quantity of solvent for the adhesive material carried by the cover-slips, compressing each slide with a cover-slip superimposed thereon in a nip at the application station so as to spread the solvent thereon over an area therebetween to cause the cover-slip to adhere to the slide, and delivering the finished slides, with cover-slips applied thereto, successively to a removable cassette for storage in stacked compartments therein, the several steps being carried out in correctly timed relation so that fully automatic application of the cover-slips to the slides is achieved.

BRIEF DESCRIPTION OF THE DRAWINGS

For a better understanding of the invention, reference is made to the following detailed description of a representative embodiment, taken in conjunction with the accompanying drawings, in which.

DESCRIPTION OF A PREFERRED EMBODIMENT

Figure 1:
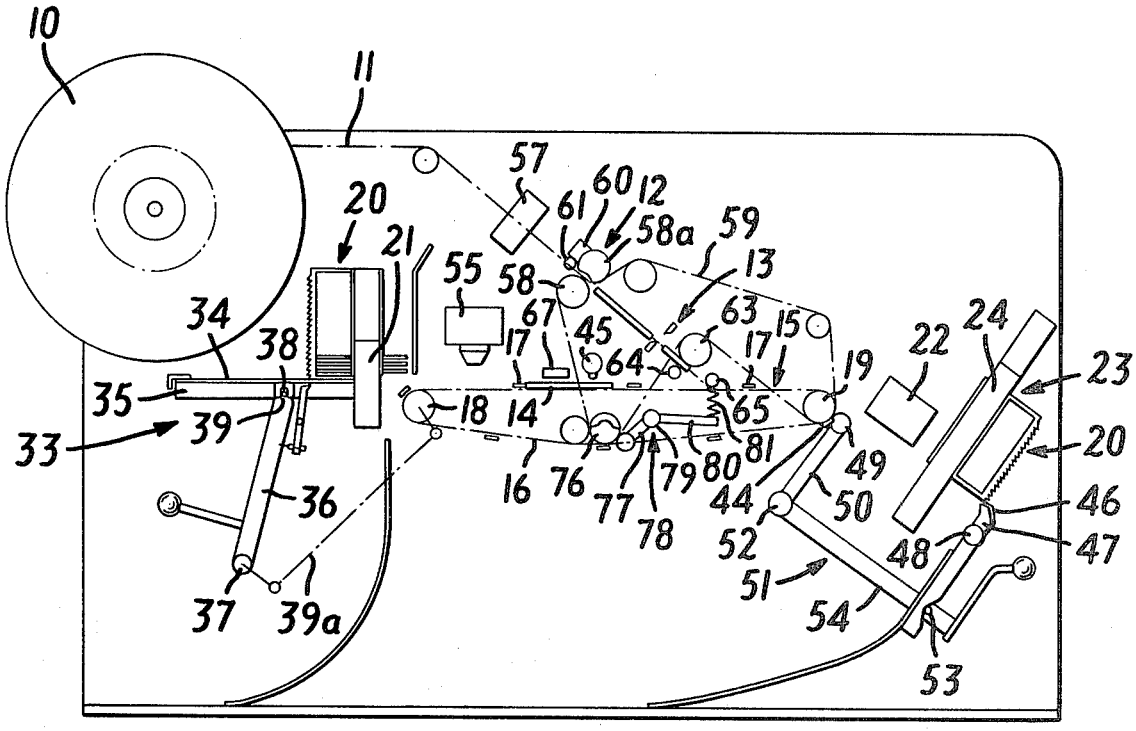
FIG. 1 is a schematic front view of a fully automatic apparatus according to the invention for the application of cover-slips on slides.

The apparatus according to the invention is based on the manually operable machine shown in the abovementioned U.S. Pat. No. 4,203,797, for mechanical application of cover-slips on slides carrying specimens for microscopic examination. It comprises a supply spool 10 (FIG. 1) onto which is wound a ribbon of cover-slip material 11 such as plastic foil, for example, which is adapted to be advanced by feed mechanism 12 and cut into suitable lengths by severing mechanism 13, for application to slides 14 fed by means of a conveyor 15. The conveyor 15 may be an endless belt 16 having spaced-apart slide pushers 17 thereon and mounted on guide rollers 18 and 19, at least one of which is driven.

Preferably the ribbon material 11 is a cellulose acetate, at one surface of which a dry adhesive is applied. The adhesive should preferably be present in an amount of at least 15 g/m$^2$, preferably 20 g/m$^2$ (dry weight of the adhesive). This amount has been found necessary to completely fill the gaps in case the specimens carried on the slides 14 are irregularly applied thereon. Preferably, when applying the adhesive onto the cover-slip material (in the form of a ribbon), the solvent used is carefully evacuated prior to rolling the material into a reel to prevent adhesion of the adjacent turns.

Slides 14 to be provided with cover-slips are fed to the input end of the conveyor 15 from a storage cassette 20 mounted for stepwise downward movement between spaced-apart upstanding guides 21 in the machine. The finished slides with cover-slips applied thereto are adapted to be delivered from the conveyor 15 to a chute 22 which guides them sequentially to a collection station 23 at which they are received in stacked compartments in a cassette 20 also mounted for stepwise downward movement between spaced-apart upstanding guides 24.

Figure 2:
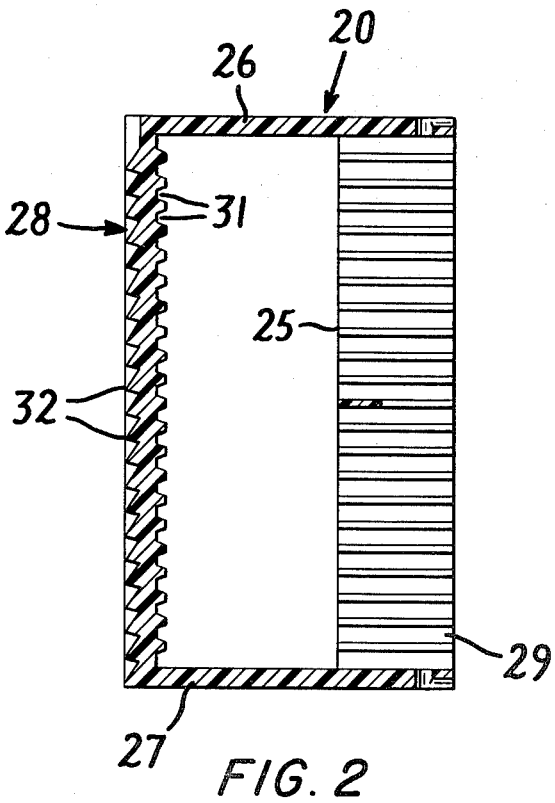
FIG. 2 is a view in vertical section, taken along the line 2—2 of FIG. 3 and looking in the direction of the arrows, of a slide receiving cassette that is used in the apparatus shown in FIG. 1.
Figure 3:
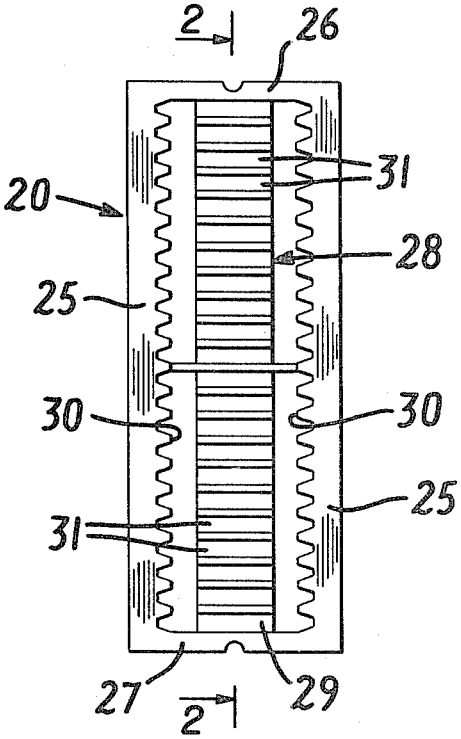
FIG. 3 is an end view of the cassette shown in FIG. 2, looking into the cartridge through the opening out of which the slides are fed.

As illustrated in FIGS. 2 and 3, the cassette 20, as positioned in the guides 21, comprises side walls 25, top and bottom walls 26 and 27, an upstanding end member 28 extending between the top and bottom walls 26 and 27 and an opposite open end 29. Inside the cassette 20, the side walls 25 are provided with a plurality of parallel, uniformly distributed, generally conical ridges 30 on which the slides are adapted to be supported. The conical design of the ridges 30 provides linear abutment between the edge sections of the slides and the ridges so that there is only line contact between the slides 14 and the ridges 30. Further support for the slides is provided by teeth or grooves 31 formed in the inside surface of the end member 28 in substantial registry with the ridges 30 as shown. Also, the outer wall of the end member 28 is provided with grooves or teeth 32 forming a ratchet adapted to cooperate with pawl means to allow the cassette to move downwardly to a succession of positions and to lock the cassette temporarily at each position during the feeding of the slides 14, as described in greater detail below.

A cassette 20 preferably also serves as a receptacle for finished slides at the collection station 23, which simplifies handling of the slides. The limited linear abutment between the conical ridges 30, the teeth or grooves 31, and the edges of the slides minimizes the likelihood that any dissolved adhesive pressed out upon application of the cover-slips on the slides will be able to adhere to slides fed into the feed-out cassette.

The slides 14 are adapted to be fed singly out of the cassette 20 onto the conveyor 15 by feed mechanism 33 (FIGS. 1 and 4) comprising an ejector 34 slidably mounted on guides 35 on the machine frame for reciprocating movement towards and away from the conveyor 15 substantially in the plane of the latter. The ejector 34 is adapted to be reciprocated towards and away from the conveyor 15 by an arm 36 pivotally mounted at 37 and having a pin 38 received in an open slot 39 under the ejector 34. The arm 36 is connected to a linkage 39*a* driven by the roller 18 so that for each revolution of the latter, the ejector 34 is advanced to feed a slide 14 and then withdrawn.

Figure 4:
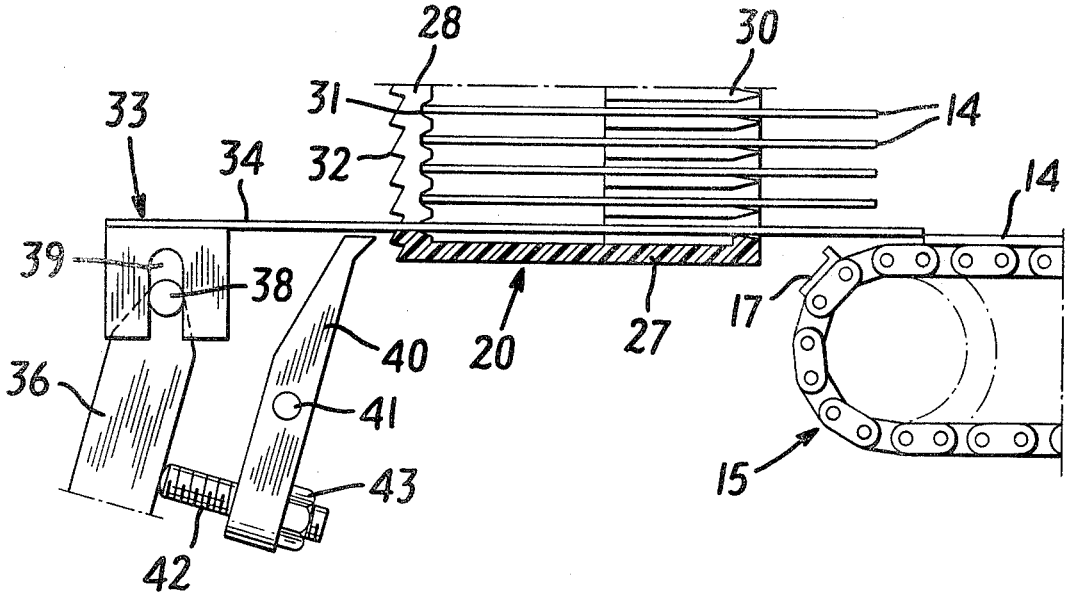
FIG. 4 is an enlarged side view, partially in section, of mechanism for feeding slides out of a cassette to the slide conveyor in FIG. 1.

As best shown in FIG. 4, a cassette 20 is adapted to be retained in the feeding position by a pawl 40 pivoted at 41 and spring biased in the clockwise direction towards the grooves 32 in the end member 28. When the ejector is advanced towards the conveyor 15, its forward end will engage the left end of the slide 14 lying in its path in the cassette 20 and move that slide to a position on the conveyor 15 just ahead of one of the slide pushers 17.

When the ejector 34 reaches its forward limit in its operating cycle, the arm 36 actuates an adjustment screw 42, adjustable by means of an adjusting nut 43 at the lower end of the pawl 40, to disengage the latter from the ratchet formed by the teeth or grooves 32 in the cassette end member 28. This will permit the cassette 20 to drop slightly until the tooth-engaging end of the pawl 40 is returned by its biasing spring towards the next lower tooth 32 in the end member 28. However, the ejector 34 prevents full engagement between pawl 40 and the teeth until it has been fully withdrawn from the cassette. When that happens, the cassette is then set in a new position enabling the next slide to be fed out by the ejector 34.

Stepwise downward movement of a cassette 20 in relation to the feed-out plane of the chute 22 at the collection station 23 is effected by a pair of pawl members 46 and 47 (FIG. 5), both pivotally mounted at 48 and spring biased towards the grooves or teeth 32 formed in the end member 28. Once during each revolution, a cam 44 driven by the roller 19 (FIG. 1) actuates a cam follower 49 on the arm 50 of a bell crank 51 pivoted at 52. Rotation of the bell crank 51 causes pin means 53 on the arm 54 thereof to actuate the pawl members 46 and 47 to cause them to engage the teeth 32 alternately to allow the cassette 20 to move one step downwardly, after which the cassette 20 remains stationary at the new position.

Figure 6A:
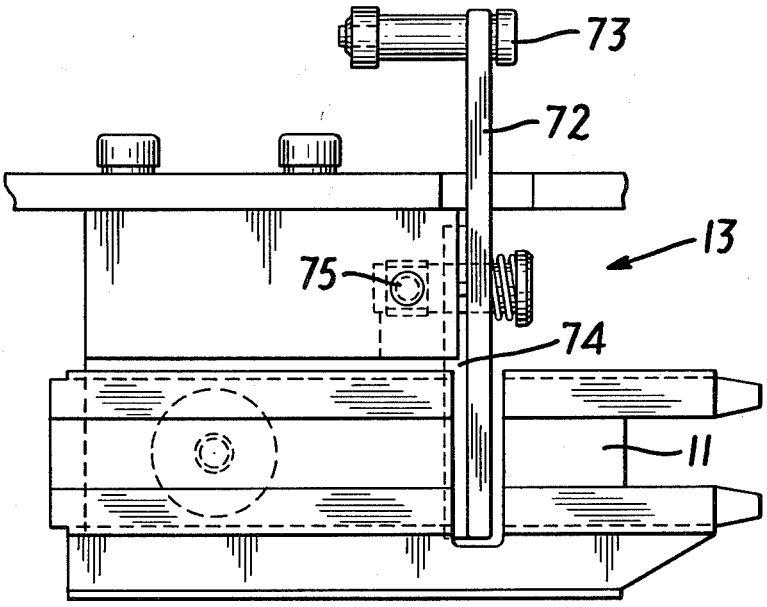
FIG. 6*a* illustrates schematically the ribbon cutting mechanism for the apparatus of FIG. 1.
Figure 6:
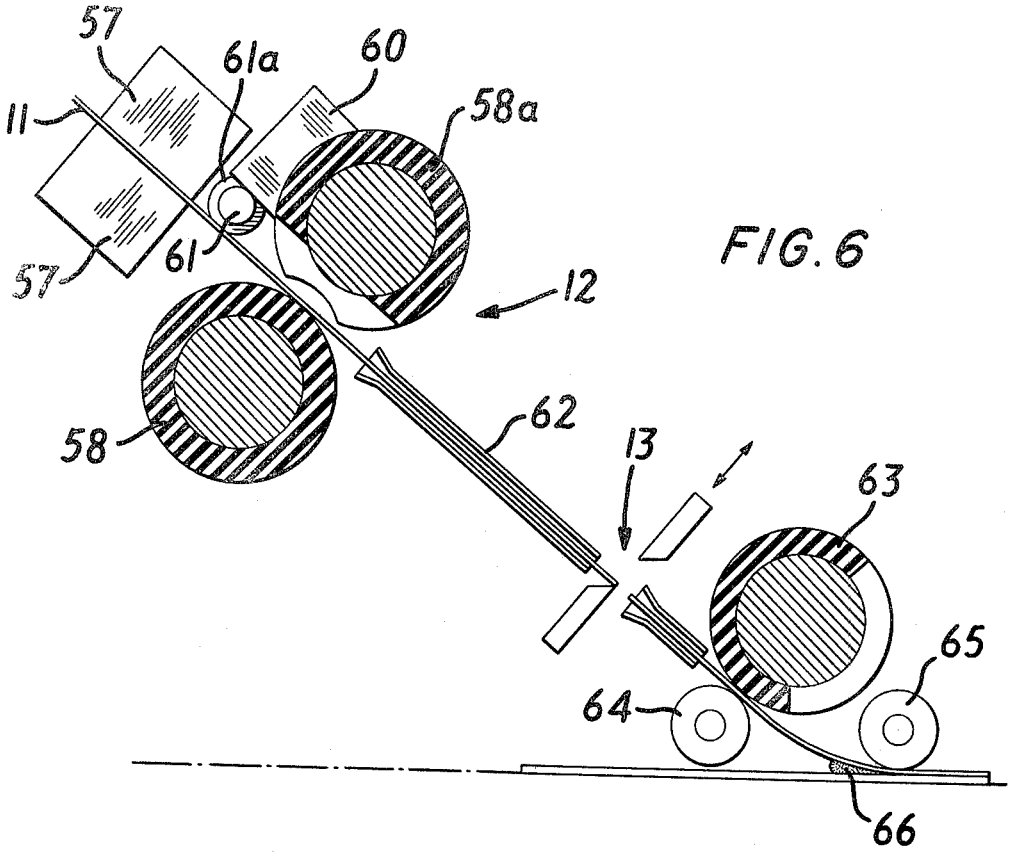
FIG. 6 is a schematic side view of means for automatically feeding and severing the ribbon material from which the cover-slips are produced in the apparatus of FIG. 1.
Figure 7A:
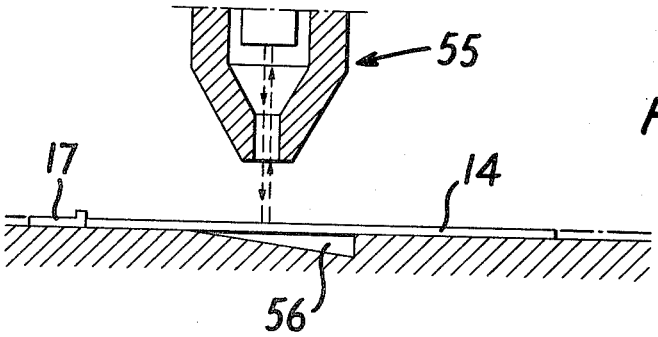
FIGS. 7*a* and 7*b* are side views of photosensitive means that may be utilized to generate control signals for use in the apparatus of FIG. 1.
Figure 7B:
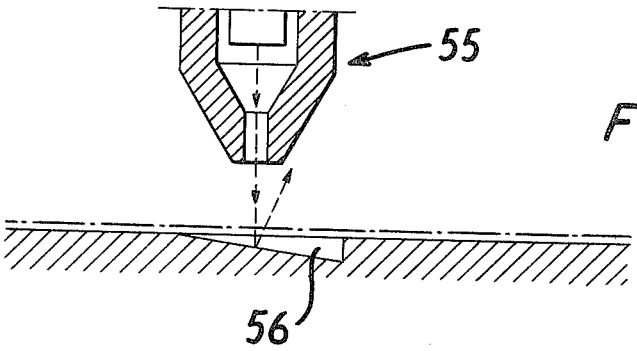

The operating cycle of the machine is controlled by signals from a photosensitive device 55 (FIGS. 1, 7*a* and 7*b*) which is disposed to generate a control signal only if a slide 14 is properly in place on the conveyor 15. As shown in FIG. 6, the photosensitive device comprises a light source adapted to direct a light beam downwardly towards the conveyor 15. If a slide 14 is correctly in place on the conveyor in front of a pusher 17, it reflects the light beam to a photocell in the device 55 and generates a control signal which activates the starting relay of the motor to drive the conveyor belt 16 and initiate a working cycle. If no slide is in place on the conveyor belt 16, the beam of light from the device 55 falls on an inclined surface 56 below the conveyor which directs it away from the photocell so that no control signal is generated.

Figure 4A:
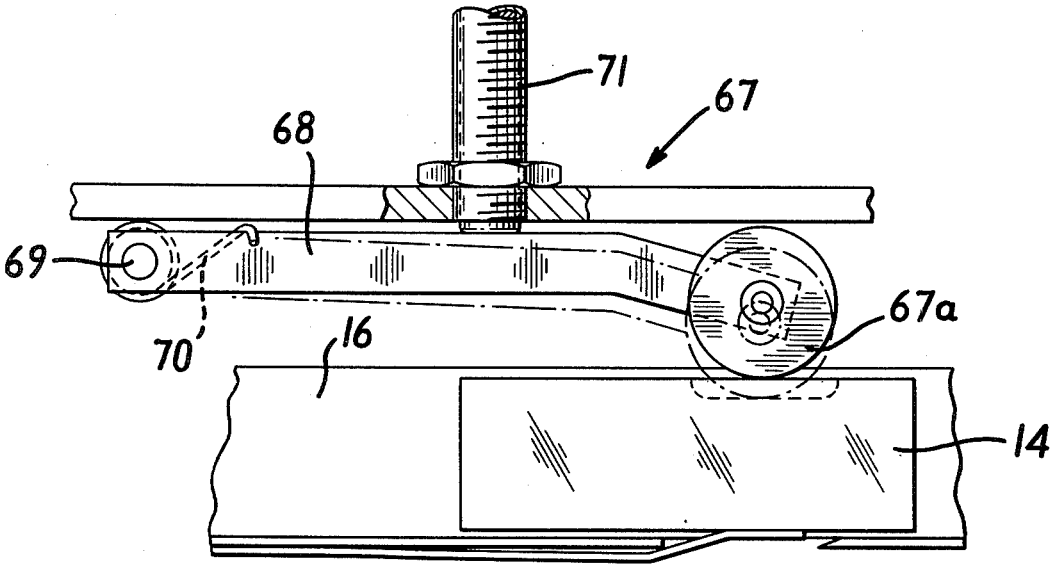
FIG. 4*a* a schematic diagonal view of mechanism for sensing the arrival of a slide on the conveyor belt at a predetermined location.

The control signal from the photosensitive device 55 is adapted to be inactivated periodically by a cam (not shown) driven by the drive shaft on which the conveyor roller 19 is mounted and it serves to prepare circuitry (not shown) to cause a measured amount of solvent to be deposited on each slide and cover-slip material to be advanced as described below. To this end, a slide position sensor 67 (FIG. 4*a*) comprising a roller 67*a* on the end of an arm 68 pivoted at 69 is urged by a spring 70 in a direction parallel to the conveyor belt 16. As a moving slide on the conveyor belt 16 arrives at the position of the roller 67*a*, it moves the arm 68 into engagement with means such as a microswitch 71 which closes a circuit to cause an electric diaphragm pump 45 to dispense a quantity of solvent on the slide adjacent the leading edge thereof.

Actuation of the microswitch 71 also energizes means to release brake mechanism 57 (FIG. 6) which normally restrains movement of the ribbon 11 of cover-slip material, and energizes a solenoid 61*a* to actuate the feed mechanism 12. Thus, energization of the solenoid 61*a* withdraws a stop 61 for a weight 60 secured to a rubber-clad roller 58*a* which has a substantially U-shaped recess formed therein facing the ribbon 11 as shown. When this occurs, the weight 60 will cause the roller 58*a* to rotate in the counterclockwise direction to grip the ribbon 11 between it and the rubber-clad portion of a cooperating roller 58 driven by a belt 59 (FIG. 1) to advance a specific length of ribbon 11 through a guide 62 and the ribbon severing means 13.

The roller 58*a* continues rotating until the weight 60 is again brought to rest against the stop 61, at which time the free edge of the ribbon 11 will have arrived at about the leading edge of the slide 14 to which it is to be applied. As soon as feeding of the ribbon 11 by the rollers 58 and 58*a* has ceased, the severing means 13 is automatically actuated to sever the piece of ribbon thus advanced, forming a cover-slip.

The severing means 13 (FIG. 6*a*) comprises a movable knife blade 72 pivoted at 73 and adapted to cooperate with a fixed blade 74 to sever the ribbon 11. Normally, the movable blade 72 is urged away from the fixed blade by a spring (not shown) and it is adapted to be pulled down to cutting position by a solenoid 75 which is energized when the drive motor has finished a working cycle and is deenergized at the beginning of the next working cycle.

To avoid slippage between the cover-slip and the slide as the latter is being advanced by the conveyor, the cover-slip should preferably be advanced by a partially rubber-cladded roller 63 also driven by the belt 59 and cooperating with a support roller 64. This insures that the cover-slip will be correctly fed depending on the speed at which the slide is fed by the conveyor. A nip roller 65 exerts a light pressure on the cover-slip and presses it down on the short side of the slide at an angle to the latter so that solvent accumulates in the angle between the cover-slip and the slide, while the cover-slip is gradually flattened out against the layer of solvent in the direction of its opposite short side.

The pressure applied by the roller 65 is increased towards the end of the application to prevent slippage between the slide and cover-slip when the finished slide is discharged at the collection station 23. To this end, a cam 76 (FIG. 1) acts on an arm 77 of a lever 78 pivoted at 79 to cause the arm 80 thereof to compress spring means 81 disposed to press a slide on the conveyor belt 16 against the roller 65.

Feeding of the cover-slip ribbon should preferably be adjusted to be performed slightly in advance of the feeding of the slide on the conveyor. This insures some slippage between the leading end of the cover-slip and the slide, with the result that the solvent is amassed on the leading edge of the slide.

In operation, a cassette 20 filled with slides 14 is inserted between the upstanding guides 21 of the machine (FIG. 1) and positioned with its bottom-most slide 14 in alignment with the ejector 34 of the feed mechanism 33. Another empty cassette 20 is inserted between the upstanding guides 24 at the collection station 23, with its lowest slide receiving position in alignment with the floor of the chute 22. At this time, the brake mechanism 57 is inactivated so that it restrains the ribbon 11 of covering material and the severed end of the latter is just at the position of the severing mechanism 13.

The drive mechanism for the conveyor belt 16 is now started and it begins to drive the belt in the forward direction a distance sufficient to accommodate a slide thereon. This causes the ejector 34 of the feed mechanism 33 to be advanced by the linkage 38*a* between the conveyor roller 18 and the arm 36. The ejector 34 engages the bottom-most slide 14 in the cartridge 20 and ejects it from the latter onto the conveyor belt 16 just in front of one of the slide pushers 17.

As the arm 36 approaches its forward limit of movement, it engages the end of the screw 42 and causes the pawl 40 to disengage the ratchet formed by the teeth 32 so that the cassette 20 is allowed to drop slightly. When the ejector 34 is withdrawn from the cassette 20, the pawl 40 reengages the ratchet and holds the cassette with the next slide 14 in position to be ejected by the ejector 34.

Successive slides 14 are ejected onto the conveyor belt 16 as the latter moves intermittently, until the first slide arrives at the position where it causes the photosensitive device 55 to generate a control signal. This activates the starting relay of the motor and initiates the apparatus performing the working cycle. As each slide passes the position sensor 67 in the operating cycle, the switch 71 closes so that a control signal is fed to the electric diaphragm pump 45 which now supplies a measured quantity of solvent to the leading edge of the slide therebelow. Each slide is so supplied with solvent as the slides are advanced intermittently by the conveyor 15.

Figure 5:
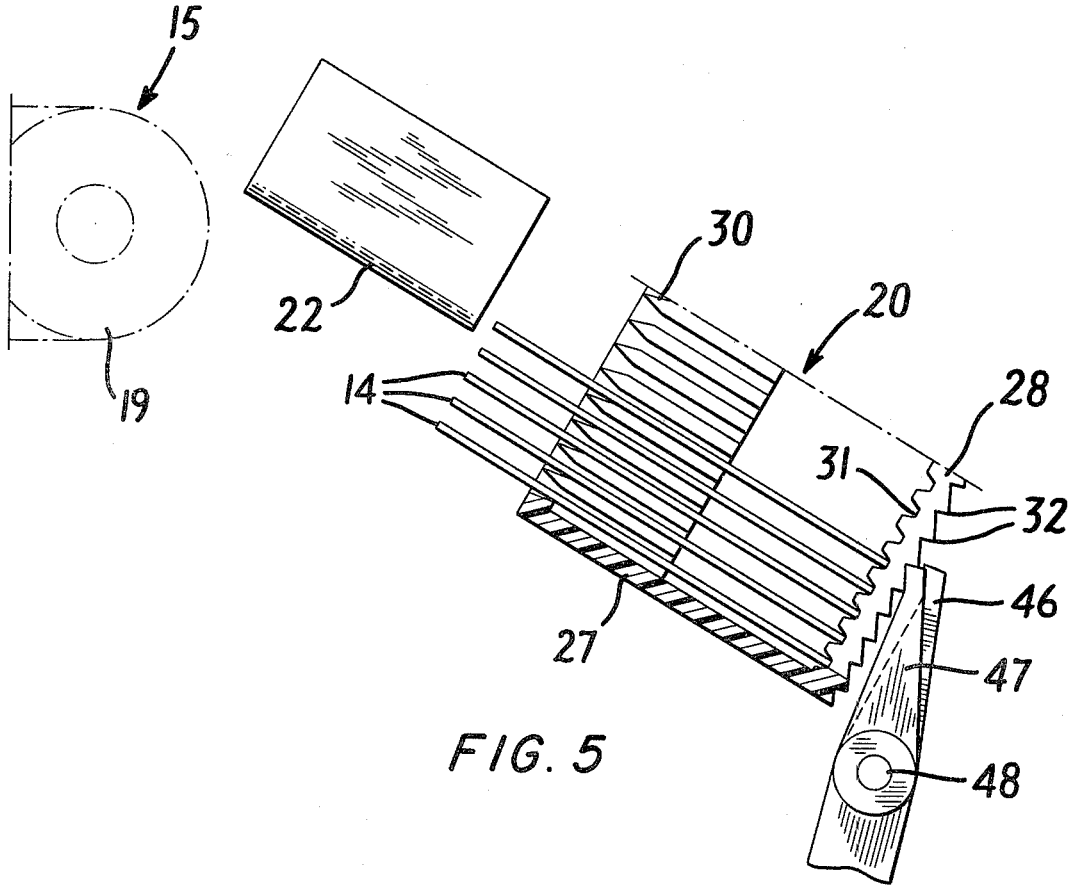
FIG. 5 is an enlarged side view, partially in section, of a feed-out station for delivery of the covered slides to compartments in a cassette.

The control signal initiated by the closing of the switch 71 also energizes the solenoid 61*a* to withdraw the pin 61. This permits the roller 58*a* to rotate in the counterclockwise direction and, in cooperation with the driven roller 58, to feed a specific length of ribbon 11 through the guide 62 until the free end thereof is in substantial registry with the leading edge 58*a* of the slide on the conveyor below. After the roller 58*a* has completed its rotation, the weight 60 again comes to rest on the stop 61 as shown in FIG. 5, and at the same time the severing means 13 is actuated to cut off a portion of the ribbon 11 which is to serve as the cover-slip.

After the foremost slide 14 with solvent at its leading end comes into registry with the cut off cover-slip, the two continue to be advanced by means of the partially rubber-covered roller 63 in cooperation with the roller 64. This avoids any slippage between the cover-slip and the slide and insures that the cover-slip is correctly fed depending on the speed at which the slide is fed by the conveyor.

The nip roller 65 presses the cover-slip against the slide so that the solvent on the latter forms a bulge 66, thereby preventing air from being entrapped between the cover-slip and the slide. As described above, the contact pressure of the nip roller is arranged to increase gradually during application of the cover-slip.

As the conveyor belt 16 continues to advance intermittently, the foremost slide with the cover-slip adhered thereto is discharged into the chute 22, which directs it to the lowermost slide receiving compartment in the cassette 20 at the collection station 23. When the conveyor 15 is next advanced by the roller 29, the cam 44 activates the cam follower 49 to rotate the bell crank 51. This causes the pawl members 46 and 47 to be actuated to permit the cassette 20 to move one step downwardly to a new location at which it remains stationary until the next cycle has been completed.

It will be understood that the invention provides novel and highly effective means for automatically applying cover-slips to slides. By virtue of the novel cassette structure, the feed mechanisms for the slides and cover-slips, together with means for operating them in the proper timed relationship, the slides can be fed to the apparatus completely automatically and the cover-slips may be severed from the ribbon supply and applied to the slides without the necessity for manual operation of any kind.

While a specific embodiment has been described above and illustrated in the drawings, the invention is not limited thereto but is susceptible to modifications in form and detail within the scope of the following claims.

I claim:

1. In apparatus for applying cover-slips on slides for specimens and the like, the combination of slide conveyor means for advancing slides past a coating station to a cover-slip application station; cassette means having means for supporting a plurality of slides in stacked relation therein; slide ejection mechanism including ejector means reciprocable in timed relation to the advancement of said conveyor means for feeding slides successively from said cassette means to said conveyor means for advancement thereby; means actuated by said ejector means for effecting stepwise movement of said cassette means to bring each slide therein successively into registry with said ejector means for movement thereby onto said conveyor means; slide coating means at said coating station; photosensitive means disposed to generate a characteristic signal when a slide is present at a given location on said conveyor means; means responsive to said signal for actuating said coating means to deposit a quantity of coating material on each slide as it is advanced by said conveyor means; means responsive to the presence of a slide at said given location for advancing a strip of cover-slip material past a severing station to said application station, said cover-slip advancing means comprising a pair of cooperating rollers forming a nip through which said cover-slip strip is adapted to pass, one of said rollers being driven in timed relation to the advancement of said conveyor means, and the other roller having a portion of reduced radius, an eccentric weight on said other roller, stop means retaining said other roller against movement with the portion of reduced radius thereof facing said one roller so that said strip is not advanced while said stop means retains said weight against movement; second means responsive to said signal for withdrawing said stop means to permit said other roller to rotate under the influence of the weight thereon to advance a specified length of said strip towards the application station to form a cover-slip; severing means at said severing station operative in timed relation to the advance of said conveyor means for severing a specified length of cover-slip material as the free end thereof arrives at the application station; nip roller means at the application station for pressing the severed cover-slip material against a slide at said station; means operated in timed relation to the advance of said conveyor means for advancing said severed cover-slip material to said nip roller means in substantial registry with the slide against which it is pressed; and means for receiving from said application station slides with cover-slips thereon.

2. Apparatus as defined in claim 1 together with second cassette means disposed beyond said application station and having a plurality of slide receiving compartments and chute means for directing slides to which cover-slips have been applied from said application station to said second cassette means.

3. Apparatus as defined in claim 2 in which said second cassette means is provided with means for supporting a plurality of slides in stacked relation, together with means actuated in timed relation to the advancement of said conveyor means for effecting stepwise movement of said second cassette means to bring each slide receiving compartment therein successively in relation to said chute means to receive a slide therefrom.

4. Apparatus as defined in claim 1 in which the cover-slip material is in ribbon form coated on one side with a dry adhesive in an amount of at least 15 $g/m^2$ (dry weight) and the slide coating means is adapted to deposit on each slide a quantity of solvent for said dry adhesive.

* * * * *

UNITED STATES PATENT AND TRADEMARK OFFICE

CERTIFICATE OF CORRECTION

PATENT NO. : 4,455,188

DATED : June 19, 1984

INVENTOR(S) : Nils G. I. Stormby

It is certified that error appears in the above—identified patent and that said Letters Patent is hereby corrected as shown below:

On first page of patent, under "References Cited" add the following U.S. Patent Documents:

| | | | |
|---|---|---|---|
| 4,146,414 | 3/1979 | Stormby | 156/57 |
| 4,203,797 | 5/1980 | Stormby | 156/521 |

Column 8, line 27, "claim 1" should read --claim 2--.

Signed and Sealed this

*Twenty-ninth* Day of *January 1985*

[SEAL]

*Attest:*

DONALD J. QUIGG

*Attesting Officer*

*Acting Commissioner of Patents and Trademarks*